United States Patent [19]

Emerson, Sr.

[11] Patent Number: 4,606,791

[45] **Date of Patent: * Aug. 19, 1986**

[54] SIZING AGENTS FOR CELLULOSIC PRODUCTS

[75] Inventor: Ralph W. Emerson, Sr., Boston, Mass.

[73] Assignee: Reichhold Chemicals, Inc., White Plains, N.Y.

[ * ] Notice: The portion of the term of this patent subsequent to Nov. 20, 2001 has been disclaimed.

[21] Appl. No.: 667,726

[22] Filed: Nov. 2, 1984

Related U.S. Application Data

[60] Division of Ser. No. 377,398, May 12, 1982, Pat. No. 4,483,744, which is a continuation of Ser. No. 165,988, Jul. 7, 1980, abandoned, which is a continuation of Ser. No. 20,480, Mar. 14, 1979, abandoned.

[51] Int. Cl.[4] ..... D21H 3/34

[52] U.S. Cl. ..... 162/180; 106/218; 106/236; 260/102

[58] Field of Search ..... 106/218, 236; 264/7, 264/11, 13, 14; 162/180; 260/102; 422/224

[56] References Cited

U.S. PATENT DOCUMENTS

| | | | |
|---|---|---|---|
| 1,522,871 | 1/1925 | DeCew | 106/213 |
| 1,890,462 | 12/1932 | Harding et al. | 106/218 |
| 2,050,996 | 8/1936 | Fredriksson | 106/218 |
| 3,036,338 | 5/1962 | Nack | 264/7 |
| 3,468,686 | 9/1969 | Schultz | 106/238 |
| 4,022,634 | 5/1977 | Emerson et al. | 106/218 |
| 4,141,750 | 2/1979 | Emerson et al. | 106/218 |

FOREIGN PATENT DOCUMENTS

| | | |
|---|---|---|
| 2352767 | 12/1977 | France . |
| 1230759 | 5/1971 | United Kingdom . |

*Primary Examiner*—Peter Chin

*Attorney, Agent, or Firm*—Rodman & Rodman

[57] ABSTRACT

Improved sizing compositions for cellulosic products, e.g., paper, are provided by combining first and second composition components while at least the second component is finely divided into fine liquid or solid particles. Component combination in this manner serves to provide especially effective sizing compositions.

The first component comprises a material which provides both ammonia and ammonium salt when combined with other materials in the composition. Such ammonia-ammonium salt-providing material comprises at least one material selected from the group consisting of ammonia, or a precursor thereof; ammonium salts, or a precursor thereof; a reaction product of urea and at least one selected Lewis acid; and mixtures of these materials.

The second component comprises a saponified, partially saponified or unsaponified rosin that is modified with either an $\alpha$, $\beta$-unsaturated aliphatic acid generally containing from about 3 to 10 carbon atoms, an anhydride of such acids, or mixtures thereof.

The improved sizing compositions produced comprise ammonia, ammonium salt and modified rosin, which components are present in sizing-effective or sizing-enhancing amounts, such that a total acidity of the composition of at least about 1000 parts per million is realized.

7 Claims, 1 Drawing Figure

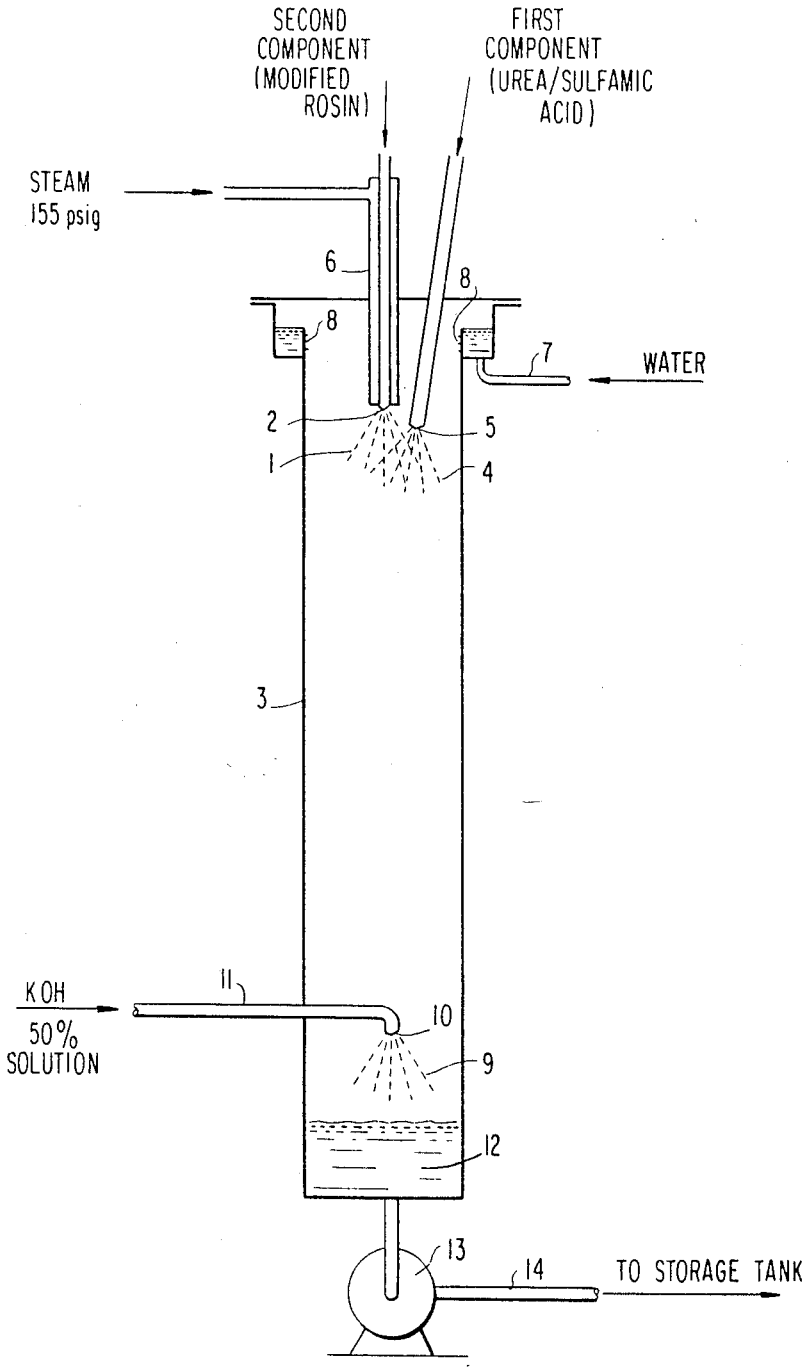
SECOND COMPONENT (MODIFIED ROSIN)
FIRST COMPONENT (UREA/SULFAMIC ACID)
STEAM 155 psig
6
8
8
7
WATER
2
5
1
4
3
KOH 50% SOLUTION
11
10
9
12
13
14
TO STORAGE TANK

SIZING AGENTS FOR CELLULOSIC PRODUCTS

This is a division of application Ser. No. 377,398, filed May 12, 1982 now U.S. Pat. No. 4,483,744 which is a continuation of application Ser. No. 165,988, filed July 7, 1980, abandoned, which is a continuation of Ser. No. 020,480, filed Mar. 14, 1979, abandoned.

This invention relates to new and improved sizing agents. More particularly this invention relates to new and improved sizing agents prepared from a specially modified rosin component and an ammonia and ammonium salt-providing material such as ammonia, and ammonium salts, or their precursors, or reaction products of urea with a Lewis acid such as sulfuryl chloride, para-toluenesulfonyl chloride, and the like. Such sizing compositions exhibit especially advantageous sizing properties due to both the nature of the components employed and the manner of combining such components.

Cellulosic products—paper, rigid paper, paperboard, molded products, and the like—basically are produced by applying a dilute suspension or solution of fibers in an aqueous medium onto a fine mesh screen through which the aqueous medium drains, leaving a thin mat of fibers. The mat is removed from the screen, furthuer liquid is expressed and the sheet is dried to form the desired product. The fibrous raw materials used in this process are generally one or more of the several types of commercially available pulp. These pulps include mechanical pulps, or groundwoods, bleached or unbleached, and chemical pulps, for example bleached, unbleached, and semi-bleached sulfate and sulfite pulps, as well as semi-chemical pulps. Other fibrous constituents used as the fibrous paper and paperboard-making raw materials include reclaimed waste papers, cotton fibers, inorganic and synthetic organic fibers, and mixtures of these materials.

The first step in paper product manufacture is pulp stock preparation. Pulps are most conveniently handled in slurry form to facilitate their mechanical treatment, non-fibrous additive mixing, and their delivery to the paper machine. Pulps are fed to the paper mill in a slurry directly from the pulping operation where both the pulping and paper-making are performed at the same location; otherwise, they are received as dry sheets or laps, and must be slushed before use. Slushing separates the fibers and disperses them in the aqueous medium with minimum detrimental mechanical effect so as to produce a consistently uniform starting material. The pulp slush or slurry is subjected to mechanical action known as beating or refining before being formed into a paper sheet. During refining, the fibers are swollen, cut, macerated, and frayed controllably to produce smaller fibrillar elements and to thereby desirably affect the physical properties of the resulting end product. Unbeaten pulp produces a light, fluffy, weak paper, whereas well-beaten pulp yields stronger, denser paper. During the beating or refining process, many non-fibrous materials are added to the pulp solution. Among these are mineral pigments for filling and loading, such as kaolin, titanium dioxide, calcium carbonate, and other well-known filling materials, coloring additives and dyes, sizing agents, and other known beater additives.

After the pulp slurry has been beaten and refined and the additives mixed into it, this pulp slurry or "furnish" is delivered to continuous sheet-forming equipment, such as a cylinder machine or a Fourdrinier, where it is discharged onto fine mesh screen through which the liquid carrier or aqueous medium drains and on which a fibrous mat is formed. This fibrous mat or sheet contains, for example, about 80 percent water when it leaves the screening and is therefore passed through one or more rotary presses for more water removal and is subsequently passed through a drying system, for example, steam-heated rotating cylinders, to yield the finished product. Molded pulp products are made on different equipment by a similar process designed to form, dry and press individual molded items such as paper plates and the like.

The sizing agents, as mentioned, are added to the paper-making process pulp slurry so as to render the finished product resistant to liquid penetration. In the alternative, the sizing agents may be excluded from the pulp additives, and may be applied to the paper after it is dried and has very effective penetration resistance. In this method, the dry sheet is passed through a size solution or over a roll wetted with a size solution. Such sheets are "tub-sized" or "surface-sized" respectively.

Among the materials currently used as sizing agents are rosin, various hydrocarbon and natural waxes, starches, glues, casein, asphalt emulsions, synthetic resins, and cellulose derivatives. Rosin is one of the most widely used and most effective sizing agents. Extracted rosin is often partially saponified with caustic soda, and processed to yield a thick paste of about 70 to 80 percent solids, of which up to about 30 to 40 percent is free, unsaponified rosin. Dry (unsaponified) rosin and completely saponified rosin are also used as sizing agents. Any of these rosins may further be modified, for example, by the addition of maleic anhydride or other supplement. At the paper mill, the rosin paste is dissolved or emulsified by diluting it to about 15 percent solids with hot water and then further diluting it with cold water under vigorous agitation to about 5 percent solids or less. This solution or dispersion is either used for surface-sizing or is added to the paper stock, for example, about 0.1 or 0.5 to 4.0 percent size based on dry fiber, usually before, but sometimes simultaneously with, for example, about one to three times as much aluminum sulfate (paper-makers alum). The aluminum sulfate is believed to form an ionically-charged precipitant with the rosin size which is attracted to oppositely-charged fiber.

Recently, it was discovered that novel sizing compositions can be produced which are more effective than the well-known types and which are compatible with presently used pulp and stock material and additives. Certain of these sizing compositions are disclosed in U.S. Pat. No. 4,022,634, issued May 10, 1977, to Emerson et al., incorporated herein by reference. These sizing compositions contain a specially modified rosin, ammonia and an ammonium salt. Other sizing compositions which exhibit these improved properties are disclosed in U.S. Pat. No. 4,141,750, issued Feb. 27, 1979, to Emerson et al., incorporated herein by reference. These sizing compositions also contain a specially modified rosin, ammonia, an ammonium salt, and additionally include the reaction product of urea with a Lewis acid such as sulfuryl chloride, para-toluenesulfuryl chloride and the like, which urea-reaction product may provide part of the ammonia and ammonium salt essentially present in the compositions.

It has now been discovered that sizing compositions such as those disclosed in U.S. Pat. Nos. 4,022,634 and 4,141,750, can be provided which exhibit sizing characteristics that are significantly improved even as compared to the compositions made by the techniques set forth in those disclosures. These improved sizing compositions are provided by combining first and second components of such compositions while the second component is finely-divided into liquid or solid particles. In one embodiment of the invention, the first component may also be finely divided into either fine liquid or solid particles for combination with the finely-divided second component. Combination of composition components in this manner apparently accelerates the chemical reaction between materials in the two components, and this provides compositions which are surprisingly efficacious sizing agents.

The first composition component comprises one or more materials which provide both ammonia and ammonium salt when combined with other sizing composition components. This ammonia/ammonium salt-providing material is selected from the group consisting of ammonia, or a precursor thereof; ammonium salts, or precursors thereof; and reaction products of urea and at least one Lewis acid selected from sulfuryl chloride, chlorosulfonic acid, thionyl chloride, benzenesulfonyl chloride, benzenesulfonic acid, ortho-toluenesulfonic acid, para-toluenesulfonic acid, ortho-toluenesulfonyl chloride and para-toluenesulfonyl chloride. Mixtures of these ammonia/ammonium salt-providing materials may also be employed. Ammonia, e.g., ammonium hydroxide which is an aqueous solution of ammonia, and ammonium salt can be employed as such in the first component, or precursors which produce ammonia and/or amonium salt, e.g., in situ, in the sizing composition, can be used in the first component. For instance, as more fully described in U.S. Pat. No. 4,022,634, the ammonia and ammonium salt may be produced as the reaction product of urea and an acid and, optionally, additional ammonia or ammonium salt may be added to the urea-acid reaction product, ammonia may be reacted with salt-producing ingredients, e.g., acids, of the rosin to provide ammonium salt, or ammonium salt can be reacted with ammonia-producing ingredients of the rosin to provide ammonia. Acids which can be used to react with urea to produce the ammonium salt and which may be present in the first or second component include sulfamic acid, and phosphoric acid, as well as oxalic acid, methanesulfonic acid, trichloroacetic acid, nitric acid, sulfuric acid, hydrochloric acid, stearic acid and acetic acid.

The first component may also contain the reaction product of urea with at least one selected Lewis acid as more fully described in U.S. Pat. No. 4,141,750. To form the reaction product, the urea and at least one Lewis acid selected from the group consisting of sulfuryl chloride, chlorosulfonic acid, thionyl chloride, benzenesulfonyl chloride, benzenesulfonic acid, ortho- or para-toluenesulfonyl chloride, and ortho- or para-toluenesulfonic acid are mixed together and reacted. The preferred Lewis acids are sulfuryl chloride, chlorosulfonic acid, benzenesulfonyl chloride and benezenesulfonic acid, and the most preferred acids are ortho- or para-toluenesulfonyl chloride and ortho- or para-toluenesulfonic acid. If water is present, it is advantageously included in amounts, parts by weight, approximately equal to the urea plus Lewis acid, although urea may be reacted with the Lewis acid using water in excess of equal parts, or with little water or without water. If the Lewis acid is a solid, the reaction with urea may be carried out at a temperature somewhat above the melting point of the acid.

The urea is generally reacted with the Lewis acid in such amounts and at a temperature sufficient to cause a change in the pH of the mixture from an acidic pH before the reaction begins to a basic pH as the reaction is completed as determined by a pH meter. This temperature will generally range from about 100° C. to 215° C. and is dependent to some extent upon the water content of the mixture, and may generally be higher for mixtures having a low water content.

Although the pH change is an important indication that the urea-acid reaction is complete, a more important consideration is the total acidity of the first component reaction product. This total acidity is measured as the amount of sodium hydroxide, expressed as the equivalent parts by weight of calcium carbonate, required to impart a pink color to a million parts of a phenolphthalein-containing, 50 weight percent, aqueous solution of the reaction product, and may be determined by use of the Hach Chemical Company Total Acidity Test (Hach Chemical Co., Ames, Iowa, Model AC-5 Acidity Test Kit). When the acid is reacted with the urea, ammonia and an ammonium salt are produced and this reaction not only raises the pH but also affects the total acidity of the mixture. Although it is not fully understood, this higher first component acidity (higher than pure urea) is believed, in part, to account for the ultimate superior sizing composition, i.e., agent, obtained. Thus, the amount of acid to urea is an important aspect, and is best defined in terms of the resulting total acidity (ppm) which it creates. The desired minimum total acidity is at least about 1,000 parts per million, and is preferably at least about 4,000 ppm. The actual amount of acid reacted with the urea is generally at least about 0.1 percent, and preferably from about 0.2 percent to about 8.0 percent, based on the weight of the urea, although more may be used, e.g., 15 or 20 percent acid, based on the weight of the urea, to achieve the desired results.

Reaction of the urea with the acid is preferably, but not necessarily, conducted out of the presence of the rosin and the organic acidic material used to modify the rosin. If desired, however, the urea can be reacted with the Lewis acid while in admixture with the modified rosin, as more fully discussed hereinafter.

Optionally, amounts of additional ammonia, for instance up to about 6 percent by weight of the total mixture of ammonia, water and urea-acid reaction product may be added to the mixture of the urea-acid reaction product and water after it has cooled to room temperature to enhance the sizing results achieved upon combination with the specially modified rosin. For example, 20 parts of 29 percent aqueous ammonia can be mixed at room temperature with 80 parts of the mixture of the urea-acid reaction product and water. This mixture can then be combined with the modified rosin second component as more fully discussed hereinafter.

In another embodiment, an additional ammonium salt is combined with urea and a Lewis acid selected from the group consisting of sulfuryl chloride, chlorosulfonic acid, thionyl chloride, benzenesulfonyl chloride, benzenesulfonic acid, p- or o-toluenesulfonyl chloride, and p- or o-toluenesulfonic acid to provide sizing agents of the present invention. The additional ammonium salt is in addition to the ammonium salt produced by the reaction between urea and the selected Lewis acids of this invention, and at least essentially the entire amount, e.g., at least about 90 weight percent, of the ammonium salt formed through reaction with urea with an acid, is advantageously provided by reaction with the selected Lewis acids of this invention. The proportion on a weight basis of the urea to the additional ammonium salt, if employed, may often range from about 2 to 1 to about 1 to 4, and preferably is about 1 to 1 to 1 to 4. This reaction product first component may then be combined with modified rosin, instead of the urea-acid reaction product alone, to yield a sizing agent.

The ammonium salt employed in the first component of the present invention may be the salt of an ammonium salt-producing acid which reacts with ammonia to produce an ammonium salt such as, for instance sulfamic acid, chlorosulfonic acid, phosphoric acid, oxalic acid, p-toluenesolfonic acid, trichloroacetic acid, hydrochloric acid, sulfuric acid, methanesulfonic acid, nitric acid, stearic acid, acetic acid and sulfuryl chloride. Solid preformed ammonium salts may be used, or, alternatively, the salt may be formed by reaction of the desired acid with ammonia. Thus, for example, dry powders of ammonium sulfate, urea, and chlorosulfonic acid are heated together to about 160° C. at which temperature the mixture goes from an acid pH to an alkaline pH of about 8 to provide the ammonia/ammonium salt-containing first component.

The second component of the sizing compositions herein comprises a rosin that is modified with an organic carboxylic acidic material which can be an $\alpha$, $\beta$-unsaturated organic acid, an anhydride of such, an acid or mixtures of such acids and anhydrides. The $\alpha$, $\beta$-unsaturated acid or derivative can be, for example, an $\alpha$, $\beta$-unsaturated aliphatic acid generally containing from about 3 to 10, preferably from about 3 to 6, carbon atoms, as for example, acrylic acid, and those preferred include maleic acid, maleic anhydride and fumaric acid.

Rosin is a mixture of resin acids (including abietic, pimaric, and levopimaric acids), hydrocarbons and high molecular weight alcohols, which is obtained from any of several sources. Gum rosin is the residue remaining after distillation of turpentine oil from crude turpentine oleoresin obtained from living pine trees, wood rosin is the residue remaining after distilling off volatile fractions of the solvent extraction product (usually using naphtha as the solvent) from pine stumps, and tall oil rosin is a byproduct in the fractionation of tall oil (an oily mixture of rosin acids, fatty acids and neutral materials obtained from the acid treatment of spent black liquor from paper and pulping processes). All three types are very similar chemically, except that tall oil rosin often contains 1 to 5 percent fatty acids remaining after fractionation, whereas gum rosin and wood rosin do not. As mentioned above, rosin may be used in sizing agents in "dry" form, or may be partially or completely saponified. In the sizing compositions of the present invention, gum rosin, wood rosin, tall oil rosin, or their mixtures, may be used. Tall oil rosin is preferred, however, as it generally produces the best results, possibly due to the presence of the fatty acids in it, although this is not fully understood.

As mentioned, the organic acidic materials which may be used to modify the rosin are $\alpha$, $\beta$-unsaturated organic acids and anhydrides and their mixtures. Amounts of the organic acidic material used to achieve the desired results generally range from about 5 to 50 percent or more, based on the weight of rosin, but preferably from about 5 to 30 percent is used, particularly about 15 percent. The modified rosin can be formed into a soap by known methods, for example, by adding sodium hydroxide, potassium hydroxide, or ammonium hydroxide to form an alkali metal or ammonium soap of the rosin acids. Generally, the rosin can be saponified after it is modified. In any event, saponification need not be complete, but is preferably sufficient to render the final sizing composition water soluble. With respect to the embodiment of the present invention comprising the reaction product of ammonia and modified rosin, ammonia is preferably used as one of the saponifying bases.

In accordance with the present invention, the first and second composition components as described hereinbefore are combined while the second component, and preferably also the first component, are in a finely-divided liquid or solid state or are finely-divided mixtures of liquids and solids. The second component and optionally the first component may be finely divided into particles which may be solid or liquid, i.e. droplets, by various means that will be apparent to those skilled in the art. Advantageously the average diameter of such liquid or solid particles ranges from about 10 to 1000 microns, preferably from about 20 to 250 microns.

It has been found that conversion of the second component into fine particles can be accomplished by adding the liquid or solid second component to the first component while the first component in liquid form is subjected to high shear agitation in a blender or mixing apparatus. Addition of the second component to the agitated first component liquid serves to finely divide the second component as it contacts the agitated liquid. The blender or mixing apparatus agitating element can be operated at a speed that provides shear agitation which is sufficient to finely divide the second component being added into particles having an average diameter within the 10 to 1000 micron range. A Waring blender operating with a mixing element speed of from about 10,000 to 25,000 r.p.m. can, for example, be used to agitate the first component as the second component is combined therewith.

Alternatively, when the two components are in the liquid form, both components can be forced through spray nozzles and the two streams of spray combined in a suitable container. In this manner both the first and second components are divided into droplets within the aerosol size range. Advantageously, the nozzles employed produce droplets having an average size of from about 10 to 200 microns, preferably from about 20 to 125 microns. As an example of nozzles which can be used successfully, the second component can be sprayed from nozzle No. 49487650 manufactured by Spray Engineering Company, East Spit Brook Road, Nashua, N.H. 03060, while the first component is sent through a similar full cone center jet nozzle also manufactured by Spray Engineering Co. Steam under pressure is a suitable gas for forcing the second component through such a nozzle. The first component spray can be formed with or without using a pressurized driving gas. Streams from the two nozzles can then be combined to effect component mixing while both components are in a finely-divided state.

In combining the first component with the second component to form a sizing composition according to the process of the invention, sufficient amounts of each component are used to provide sizing effective amounts, generally from about 25 to 85 percent based on the total dry weight of the sizing composition, of the first component, and from about 75 to about 15 percent of the second component, in the sizing composition.

The sizing composition made by the process generally contains at least about 25 weight percent, often about 40 to 60 percent, water.

While the second component, and optionally the first component, is finely-divided according to the process into fine liquid or solid particles, the components can simply be mixed at room temperature. Less advantageously, these components may be mixed and heated to the boiling point of the mixture to assure that all reactions are completed.

When the first component and the second component are combined at an elevated temperature, the modified rosin may be heated to or kept at a temperature at which the combination may be carried out. This combining may comprise adding a diluted mixture of the first component reaction product, which is heated, to the heated second component, in order to effect chemical and physical mixing. The mixture of first and second components can be heated at above 212° F. to boil off the water, and is preferably kept at the boil-off temperature until the cloudy solution becomes substantially clear. Optionally, after component combination is completed, very small amounts of ammonium hydroxide may be employed to adjust the pH of the product back into the basic range, i.e., to greater than 7 if it has dropped into the acidic range, i.e., below 7. Amounts of ammonium hydroxide, up to about 0.05 percent by weight of the mixture, will generally raise the pH to the desired range. The selection of first component and second component dilution concentrations prior to component mixing is dependent on the desired relative amounts of first component and second component and on the desired concentration of the resulting sizing compositions. The choice of combination temperatures employed is a function of workability and of the desired degree of chemical and physical mixing, although in an embodiment of the process, temperatures of at least about 80° F. may prevent precipitation on mixing.

As mentioned above, ammonia, an ammonium salt, and the specially-modified rosin or a soap of the specially-modified rosin may be combined at room temperature to yield a sizing agent. The soap of the specially-modified rosin can be prepared by pouring the hot mixture of the rosin and the rosin-modifying organic acidic material into an aqueous solution of a saponifying base, e.g., sodium hydroxide and/or potassium hydroxide, under slow agitation to saponify the modified rosin. Sufficient aqueous solution of the saponifying base can be used to produce an aqueous mixture of modified rosin soap containing from about 50 to about 70 weight percent solids. Based on the total weight of the ammonia, the ammonium salt, and the rosin and the modifying organic acidic material on a dry basis, the sizing agent may have from about 3 percent to about 30 percent ammonia, from about 4 percent to about 72 percent ammonium salt and from about 93 to about 25 percent rosin plus modifying organic acidic material, using a ratio of ammonium salt to ammonia that is greater than about 1:1. The term "dry" is used throughout this specification to mean exclusive of any water which is present. The ammonia may be produced in situ by, for example, reaction between the rosin, the modifying organic acidic material, and the ammonium salt by using from about 4 percent to about 75 percent rosin plus modifying organic acidic material based on the total weight of the ammonium salt and the rosin and modifying organic acidic material on a dry basis.

The amount of ammonia used depends upon whether or not ammonia is the sole saponifying agent used. When ammonia alone is used to saponify the specially-modified rosin, about 10 percent to about 75 percent ammonia, and from about 25 percent to about 90 percent rosin plus modifying organic acidic material based on the total weight of the ammonia and the rosin plus modifying organic acidic material on a dry basis, can generally be used to prepare the sizing agent. When ammonia is reacted with a soap of the specially-modified rosin, the mixture can generally be prepared with from about 4 percent to about 60 percent ammonia, and from about 96 percent to about 40 percent rosin plus modifying organic acidic material, based on the total weight of the ammonia and the rosin plus modifying organic acidic material on a dry basis.

Procedures involved in the preparation of the sizing compositions herein, besides the aspect of combining components while the second component, and optionally both components, are finely divided, are set forth in the specification of U.S. Pat. Nos. 4,022,634 and 4,141,750, both of which are incorporated herein by reference.

The sizing agents of this invention have a pH generally in the range of about 6.6 to about 10 and a total acidity of at least about 1000 parts per million. This total acidity is measured as the amount of sodium hydroxide, expressed as equivalent parts by weight of calcium carbonate, required to impart a pink color to a million parts of phenolphthalein-containing sizing composition of the present invention, and may be determined by use of the Hach Chemical Company Total Acidity Test (Hach Chemical Co., Ames, Iowa, Model AC-5 Acidity Test Kit). The prefered objective of each of the embodiments of the sizing agent of the present invention is to obtain the highest total acidity possible without lowering the pH to a level which makes the sizing agent insoluble in paper mill water. Thus, the proportions of the ingredients of the sizing compositions of the present invention can vary in accordance with this objective and are thus conveniently defined in terms of the pH and total acidity they produce in the sizing agents.

These improved sizing compositions exhibit superior sizing properties compared to conventional sizing agents when used in the same amount, and equivalent properties can be obtained when used in lesser amounts, than the conventional sizing agents, thus enabling the user to meet existing standards with less sizing agent than heretofore required, and, therefore, at a lower cost. The products resulting from the use of the sizing compositions of this invention can be brighter and stronger than those produced by the heretofore available sizing agents. The novel sizing compositions also assist in the drying of the sheet when employed as a pulp additive so that the paper-forming machine may be speeded up to produce a sheet of the same moisture content. Alternatively, more water may be added to the pulp stock to give the fiber on the paper machine wire a better orientation, thereby producing a stronger paper with superior formation. The novel sizing compositions are normally employed along as a sizing agent with papermaker's alum in pulp stock or on surface sizing, but may be combined with various sizing agents to replace a substantial part of those known agents.

The improved sizing composition may be employed as a pulp additive or as a surface sizing agent in the manufacture of cellulosive products. The exact amount to be used to produce optimum results may vary, depending upon the type of pulp used and the desired properties of the finished product. Amounts generally less than those currently used with known sizing agents may generally be used to produce substantially equivalent or superior products. Thus, for example, while known resin sizing agents are generally used in amounts from about 0.1 or 0.5 percent up to about 4 percent of solids based on the weight of fibers of the pulp slurry, the sizing compositions of this invention may be used in amounts as low as about 0.05 percent or 0.25 percent. Thus, from about 0.05 to 0.25 up to about 4 percent of the sizing compositions herein, by dry weight based on the weight of fibers in the pulp slurry, may be used. Typically, where 1 percent of known rosin sizing agent is normally used, 0.5 percent of the novel agent of this invention can be used to obtain substantially equivalent or superior results.

Preparation of the sizing compositions in the manner specified herein also permits formulation of less costly compositions. This can be accomplished since less of the relatively more costly components (e.g., the modified rosin) need be utilized to prepare sizing compositions which have sizing effectiveness substantially equivalent to compositions prepared in known manner which contain more of the relatively more expensive components.

BRIEF DESCRIPTION OF THE DRAWING

The FIGURE shows an apparatus for practicing the invention method.

The methods of this invention are further illustrated by the following examples.

EXAMPLE 1

The first component of a sizing agent is prepared by placing 4,000 grams of commercially available urea, 200 grams of sulfamic acid, and 4,200 grams of water in a cooking vessel, and subsequently applying heat while slowly agitating the contents until the reaction mixture boils at atmospheric pressure. When the temperature reaches about 103° C., boiling stops, water losses cease, and the pH of the solution, as determined by a pH meter, rises to about 8. The resulting first component product is a clear solution having a total acidity of 86,000 ppm, as determined with the Hach Chemical Company's Acidity Test Kit Model AC-5.

To form the modified rosin second component, 3,000 grams of commercially available tall oil rosin is melted in a cooking vessel. To the molten rosin is added slowly with agitation the following ingredients: 360 grams of fumeric acid plus 100 grams of 37 percent formaldehyde and 3 grams of para-toluenesulfonic acid an rosin crystallization inhibitors. The reaction mixture is then heated with continuous agitation to about 205° C. and held at this temperature 2 to 10 hours.

To form the sizing agent, the first component in the amount of 600 grams and 300 grams of water are placed in a high-speed blender, e.g., a Waring blender. The second component (300 grams), either molten or in the form of solid particles, is added to the contents of the blender and agitated for a period of from 10 to 60 seconds and preferably about 20 to 30 seconds. Addition of the second component in this manner insures that the second component is finely divided as it contacts the agitated first component.

Potassium hydroxide (60 to 120 grams) in the form of a 50 percent by weight water solution is then added and blended for 5 to 10 seconds. The pH of the solution is then adjusted with sodium hydroxide to a value in the range 9.0 to about 10.0, and sufficient water is added to bring the total solids content of the solution to about 50 percent by weight.

The first neutralization can be done with sodium hydroxide, but if this is done, the second neutralization should be done with potassium hydroxide.

EXAMPLE 2

A first component of a sizing agent is prepared in the same way as that given in Example 1.

To form the second component, 3,000 grams of commercially available tall oil rosin is melted in a cooking vessel. To this rosin is added slowly with moderate agitation 360 grams of fumaric acid. The reaction mixture under continuous moderate agitation is then heated to about 205° C. and held at this temperature 2 to 14 hours. The hot reaction product is then carefully added to a warm solution of 700 grams of sodium hydroxide dissolved in 4,032 grams of water. The pH of the final second component solution has a value of about 10.0.

To form the sizing agent, the second component and additional water are mixed in the following proportions:

| | |
|---|---|
| Second Component | 115 grams |
| Additional Water | 115 grams |
| Total | 230 grams |

This mixture is then combined with 190 grams of the first component to form a total of 420 grams of sizing agent.

EXAMPLE 3

The first and second components of a sizing agent are prepared in the same way as that given in Example 1.

To form the sizing agent, the first component in the amount of 600 grams and 300 grams of water are placed in a high-speed blender, e.g., a Waring blender. Three hundred (300) grams of the second component, either molten or in the form of solid particles, is added to the contents of the blender and agitated for a period of from 10 to 60 seconds and preferably about 20 to 30 seconds.

Potassium hydroxide (60 to 120 grams) in the form of a 50 percent by weight water solution is then added and the solution agitated for a few seconds. The pH of the solution is then adjusted with sodium hydroxide to a value in the range of 9.0 to 10.0 and sufficient water is added to bring the total solids content of the solution to about 50 percent by weight.

Sodium hydroxide can be used for the first neutralization, but if this is done, potassium hydroxide should be used for the second neutralization.

EXAMPLE 4

In an apparatus such as that illustrated in the drawing, the second component prepared as in Example 1 in the amount of 1,000 parts is formed into a spray 1 by forcing it through an adjustable cone pattern nozzle 2 (e.g., Nozzle No. 49487650 manufactured by Spray Engineering Co., East Spit Brook Road, Nashua, N.H. 03060). Spray 1 is injected into a tube 3 where it meets a spray 4 of first component, also prepared as in Example 1, issuing from a full cone center jet nozzle 5. The temperature of the second component is at about 182° C. and the nozzle 2 through which it passes is heated by a shroud 6 filled with steam at about 155 psig and at a temperature of about 182° C. The amount of first component is 2,000 parts of a 50 percent by weight solids product. Water from duct 7 in the amount of 1,000 parts, less the amount of steam coming from the openings in the shroud 6 around the nozzle 2 for the second component, is introduced into the apparatus through openings 8 to wash down the walls of the tube 3 and prevent a build-up of solids. The reaction product meets a spray 9 of 50 percent by weight potassium hydroxide solution containing from 200 to 400 grams of potassium hydroxide introduced into the tube 3 through opening 10 in duct 11. The resulting solution 12 is then pumped to a storage tank not shown by a pump 13 through duct 14 where the pH value is adjusted to from 9.0 to about 10.0 with either KOH or NaOH.

The two nozzles 2 and 5 in the drawing are shown in a configuration such that the two streams of droplets, i.e., sprays 1 and 4 of the second component and first component move concurrently. Other arrangements of the nozzles 2 and 5 may be used including one wherein the nozzles are placed horizontally on a diameter of the tube 3 so that the streams of droplets are directly opposed to each other.

The drawing shows water being run down the inside of the pipe to prevent a build-up of solids. An alternate method would be to have a series of water sprays arranged around the inside periphery of the pipe.

EXAMPLE 5

To test the sizing agents produced by the process of this invention, samples of the products of Examples 1, 2 and 3 are treated as follows. The sizing agents are mixed with papermaker's alum in bleached hardwood kraft to compare their performance. Handsheets are made using 5.7 grams of fiber diluted in water to a 1.0 percent by weight slurry. The fiber and water are blended in a Waring blender for about one minute and then the sizing agents in the amount of 10 pounds per ton of fiber are added and mixed for about 45 seconds. The alum is then added in a ratio of 15 pounds per ton of fiber.

The slurries are then diluted further with water to a fiber solids content of about 0.1 percent based on the weight of the slurry. Sheets are then formed with a Williams Handsheet Former from slurries made with the sizing agents exhibited in the examples. The sheets are placed between two blotters and then dried in a hot press having a temperature of about 110° C. and exerting a pressure of about 50 pounds per square inch. The sheets are then conditioned for 24 hours at 50 percent relative humidity and 22° C. and tested by the TAPPI Hot Ink Float Test.

The ink float test which is used to compare the effectiveness of various sizing agents uses an acid ink of the following composition:

| | |
|---|---|
| 1,000 ml | distilled water |
| 5 g | Gallic acid |
| 7.5 g | $FeSO_4$ |
| 1.0 g | Tartaric acid |
| 1.0 g | Sodium benzoate |
| 3.5 g | Aniline Blue |
| 50.9 g | Formic Acid |

In the ink float test, squares of paper of a given size are placed on the surface of the liquid ink, and the time is recorded in seconds for 50 percent of the surface to be colored by the ink. In general, the larger the number of seconds recorded for a given run, the more effective is the sizing agent employed in that run.

The results obtained are shown in Table I. Each set of experiments is performed in one day with the same fiber and the same type of water. Control results will vary from day to day depending on the fiber used, the quality of the water, and possibly other factors.

TABLE I

Ink Float Tests on Sizing Agents
Ten Pounds Sizing per Ton of Paper
(Second Component Finely Divided)

| Run No. | Description of Run | Method Used to Prepare Sizing Agent | Ink Float Test Seconds |
|---|---|---|---|
| 1 | New Method | As in Example 1. Second component blended for 20 seconds. Second component added as solid particles | 924 |
| 2 | Control | Old method as shown in Example 2 | 612 |
| 3 | Same as Run 1 | New Method | 1,284 |
| 4 | Same as Run 2 | Control-Old method | 888 |
| 5 | Same as Run 1 | New method | 1,284 |
| 6 | New method | As in Example 1. Second component added as molten product at 205° C. | 1,236 |
| 7 | Old method | Control as in Example 2 | 708 |
| 8 | New method | As in Example 3 | 1,666 |
| 9 | Old method | Control as in Example 2 | 976 |
| 10 | Old method | Control as in Example 2 except saponification done with KOH | 960 |
| 11 | New method | As in Example 1. Second component blended for 30 seconds. KOH blended for 30 seconds. | 795 |
| 12 | Old method | Control as in Example 2 | 480 |

The averages of the tests of Table I are as follows: Neither Component Finely Divided (Old method): 771 seconds; Second Component Finely Divided (New method): 1,206 seconds.

This shows an improvement in the new method over the old method of $$\frac{1,206 - 771}{771} \times 100\% = 56\%$$

The values for ink float tests on the controls reported in Table I are generally higher than numbers obtained in previous work. This is attributed to the following reasons:

(a) the second component is saponified with KOH rather than with NaOH, (b) a small amount of NaOH is added to the sizing agent after the addition of the second component, and (c) a higher grade of tall oil rosin is being used to react with fumaric acid in the preparation of the second component.

EXAMPLE 6

To test the sizing agents produced by the process of this invention wherein both first and second components are finely divided, samples of products prepared as in Example 4 are tested with the Ink Float Test. Handsheet preparation and ink float procedures employed are substantially identical to those described in Example 5. The results obtained are shown in Table II. As before, each set of experiments is performed in one day with the same fiber and the same type of water.

Control results will vary from day to day depending on the handsheet size, fiber used, the quality of the water, and possibly other factors.

TABLE II

Ink Float Tests on Sizing Agents
Ten Pounds Sizing per Ton of Paper
Both Components Finely Divided

| Run No. | Description of Run | Method Used to Prepare Sizing Agent | Ink Float Test (seconds) |
|---|---|---|---|
| 1 | New method | As in Example 4. Rosin is 12% fortified with fumaric acid | 530 |
| 2 | Control | Old method as shown in Example 2. Rosin is 12% fortified with fumaric acid | 360 |
| 3 | Same as Run 1 | New method | 558 |
| 4 | Same as Run 2 | Control-Old method | 376 |
| 5 | Same as Run 1 | New method | 552 |
| 6 | Same as Run 2 | Control-Old method | 379 |
| 7 | New method | As in Example 4. Rosin is 6% fortified with fumaric acid | 384 |
| 8 | Same as Run 2 | Control-Old method | 386 |

This shows an improvement in the new method over the old method of $$\frac{547 - 372}{372} \times 100\% = 47\%.$$

Runs 7 and 8 in Table II demonstrate that a sizing composition prepared in accordance with the present invention is about as effective a sizing agent as a similar sizing agent prepared in conventional manner using twice as much of the rosin-modifying fumaric acid material.

It is claimed:

1. A process for preparing a sizing composition having improved sizing characteristics, which process comprises combining (A) a first component comprising a material which provides both ammonia and ammonium salt when combined with the other sizing composition components, said ammonia-ammonium salt-providing material being selected from the group consisting of ammonia or precursor thereof; ammonium salts or precursor thereof; the reaction product of urea and at least one Lewis acid selected from sulfuryl chloride, chlorosulfonic acid, thionyl chloride, benzenesulfonyl chloride, benzenesulfonic acid, ortho-toluenesulfonic acid, para-toluenesulfonic acid, ortho-toluenesulfonyl chloride, and para-toluenesulfonyl chloride; and mixtures of these materials; and (B) a second component comprising a saponified, partly saponified or unsaponified rosin which is modified with an organic acidic material selected from $\alpha,\beta$-unsaturated aliphatic carboxylic acids containing from about 3 to 10 carbon atoms, anhydrides thereof, and mixtures of said acids and anhydrides;

said combining of said first component and said second component being effected while said second component is in finely divided form and for a period of time up to about 60 seconds wherein each component is formed into particles having an average diameter of about 10 to about 1000 microns, to thereby provide a sizing composition or precursor thereof, which sizing composition or precursor thereof comprises sizing-effective amounts of said modified rosin, and sizing-enhancing amounts of said ammonia and ammonium salt, the amount of said modified rosin, ammonia and ammonium salt being sufficient to provide a sizing composition with a total acidity of at least about 1,000 parts per million.

2. The process of claim 1 wherein said second component is formed into fine particles as said second component is added to said first component while said first component is subjected to high shear agitation sufficient to form second component particles having an average diameter of from about 10 to 1000 microns.

3. The process of claim 1 wherein said first component is also finely divided into fine particles while said first and second components are combined, both first and second component particles having an average diameter of from about 10 to 200 microns.

4. The process of claims 1, 2 or 3 wherein the period of time is from about 10 to 60 seconds.

5. The process of claims 1, 2 or 3 wherein the period of time is from about 20 to 30 seconds.

6. The process of claim 1, 2 or 3 at the end of said period of time the combined first and second components are then contacted with an aqueous solution of one or both of potassium hydroxide and sodium hydroxide.

7. The process of claim 6 wherein the combined first and second components are contacted with an aqueous solution of potassium hydroxide and then with an aqueous solution of sodium hydroxide.

* * * * *

UNITED STATES PATENT AND TRADEMARK OFFICE

CERTIFICATE OF CORRECTION

PATENT NO. : 4,606,791

DATED : August 19, 1986

INVENTOR(S) : Ralph W. Emerson, Sr.

It is certified that error appears in the above-identified patent and that said Letters Patent is hereby corrected as shown below:

Column 9, line 6, change "resin" to --rosin--.

At column 13, at the end of TABLE II and above line 24, insert --The averages of the first six runs in Table II are as follows:

Neither Component Finely Divided (Old Method): 372 Seconds

Both Components Finely Divided (New Method): 547 Seconds.--

Signed and Sealed this

Twenty-first Day of April, 1987

*Attest:*

*Attesting Officer*

DONALD J. QUIGG

*Commissioner of Patents and Trademarks*